US008460065B2

(12) United States Patent
Pei

(10) Patent No.: US 8,460,065 B2
(45) Date of Patent: Jun. 11, 2013

(54) SANDBLASTING APPARATUS

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 414 days.

(21) Appl. No.: 12/967,053

(22) Filed: Dec. 14, 2010

(65) Prior Publication Data

US 2012/0077423 A1 Mar. 29, 2012

(30) Foreign Application Priority Data

Sep. 23, 2010 (TW) ..... 99132189 A

(51) Int. Cl.
*B24C 3/00* (2006.01)

(52) U.S. Cl.
USPC ..... 451/89; 451/29; 451/30; 451/37; 451/75

(58) Field of Classification Search
USPC ..... 451/29–31, 2, 37–39, 89, 75, 76
See application file for complete search history.

(56) References Cited

U.S. PATENT DOCUMENTS 3,687,750 A * 8/1972 Jamieson ..... 156/63
3,837,881 A * 9/1974 Hix ..... 451/30
4,093,754 A * 6/1978 Parsons ..... 427/259
4,133,919 A * 1/1979 Parsons ..... 427/259
4,612,737 A * 9/1986 Adee et al. ..... 451/29
4,656,791 A * 4/1987 Herrington et al. ..... 451/38
4,703,591 A * 11/1987 Herrington et al. ..... 451/40
4,918,873 A * 4/1990 Bass ..... 451/38
5,052,155 A * 10/1991 Blacka et al. ..... 451/78
5,307,594 A * 5/1994 Panchison ..... 451/29
5,593,528 A * 1/1997 Dings et al. ..... 156/154
5,704,824 A * 1/1998 Hashish et al. ..... 451/36
5,709,587 A * 1/1998 Shaffer ..... 451/38
5,766,061 A * 6/1998 Bowers ..... 451/89
6,077,152 A * 6/2000 Warehime ..... 451/75
6,379,214 B1 * 4/2002 Stewart et al. ..... 451/2
6,416,390 B1 * 7/2002 Mezei et al. ..... 451/37
6,422,920 B1 * 7/2002 Bouten et al. ..... 451/29
6,431,965 B1 * 8/2002 Jones et al. ..... 451/89
7,153,186 B2 * 12/2006 Popescu et al. ..... 451/6
2002/0090892 A1 * 7/2002 Mezei et al. ..... 451/38
2003/0032369 A1 * 2/2003 Carpenter ..... 451/38

* cited by examiner

*Primary Examiner* — George Nguyen
(74) *Attorney, Agent, or Firm* — Altis Law Group, Inc.

(57) ABSTRACT

A sandblasting apparatus for cutting a plate-shaped workpiece into a plurality of separate tablets includes a chamber defining a cavity, a support assembly received in the cavity, a sandblasting assembly for spraying sand toward the workpiece, a first mask located between the sandblasting assembly and the support assembly, a second mask located between the sandblasting assembly and the support assembly, and a mask switching member for selectively placing the first mask or the second mask over the workpiece. The support assembly is configured for supporting the workpiece and the tablets. The first mask cooperates with the sandblasting assembly to remove unwanted portions of the workpiece thus obtaining a tablet network consisting of a plurality of tablets and a plurality of connecting portions interconnected between the tablets. The second mask cooperates with the sandblasting assembly to remove the connecting portions of the tablet network thus obtaining a plurality of separated tablets.

16 Claims, 10 Drawing Sheets

SANDBLASTING APPARATUS

BACKGROUND

1. Technical Field

The present disclosure relates to cylindrical grinding technology and, particularly, to a sandblasting apparatus.

2. Description of Related Art

Many kinds of workpieces need to be ground to a desired shape before use. For example, optical lenses used in a digital camera are ground to a desired shape and size to allow their installation into lens barrels. Generally, in a cylindrical grinding process, a number of original lenses having a rectangular shape are bonded together by ultraviolet glue to form a cube, the cube is fixed on a fixing device and the original lenses ground to form a number of optical lenses, the glue is removed to separate the optical lenses, and the optical lenses are cleaned. However, the separation and cleaning are time-consuming and costly. Further, it is difficult to ensure the glue is completely removed, which can decrease the optical performance of the optical lenses.

Therefore, it is desirable to provide a sandblasting apparatus which can overcome or at least alleviate the limitations described.

DETAILED DESCRIPTION

Figure 1:
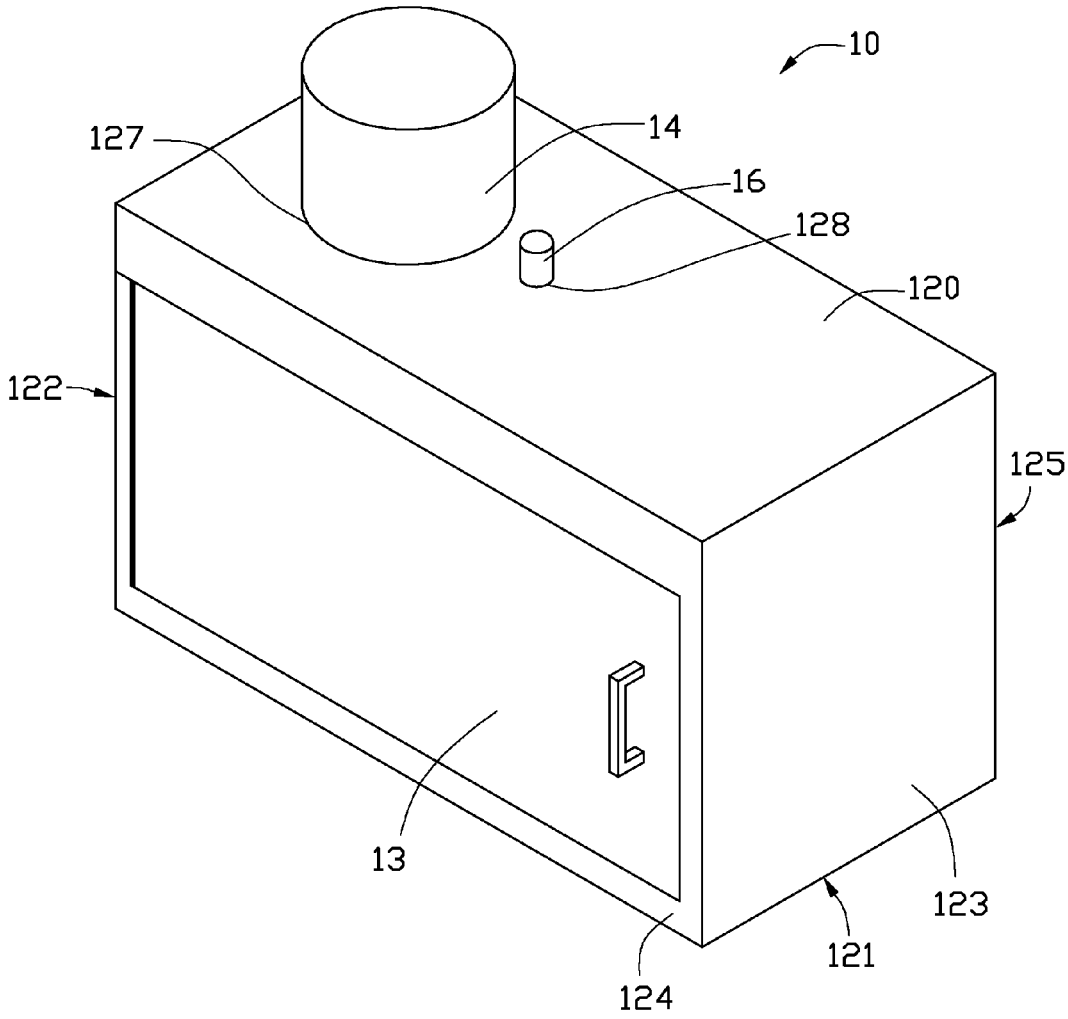
FIG. 1 is a schematic, isometric view of a sandblasting apparatus including a door according to a first exemplary embodiment, showing the door closed.
Figure 2:
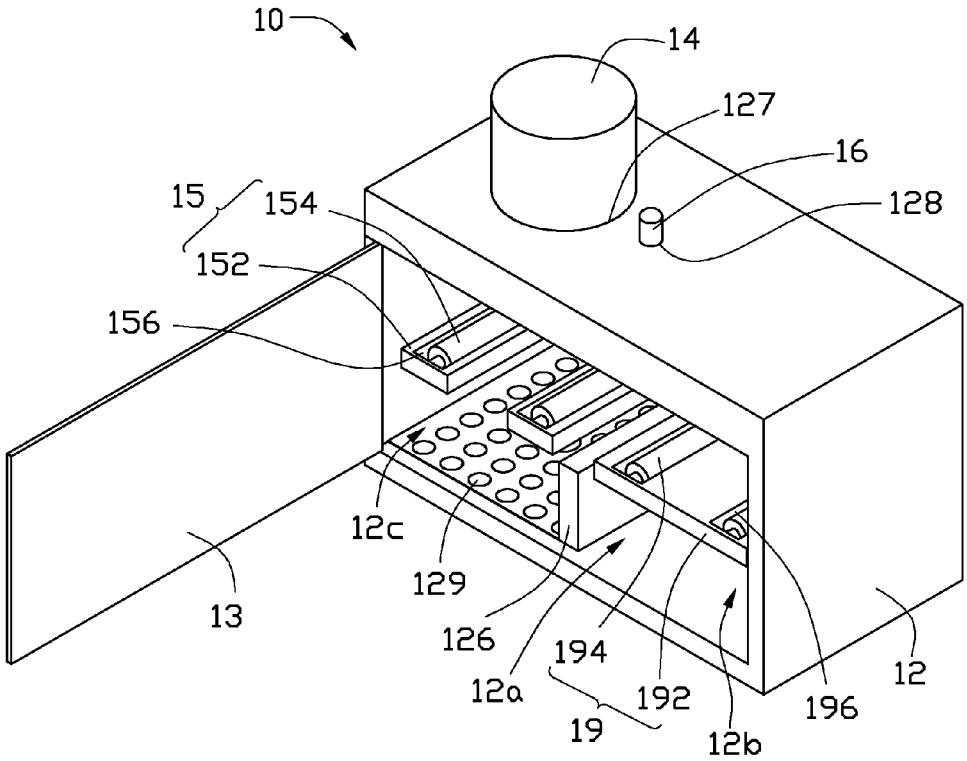
FIG. 2 is similar to FIG. 1, but showing the door open.
Figure 3:
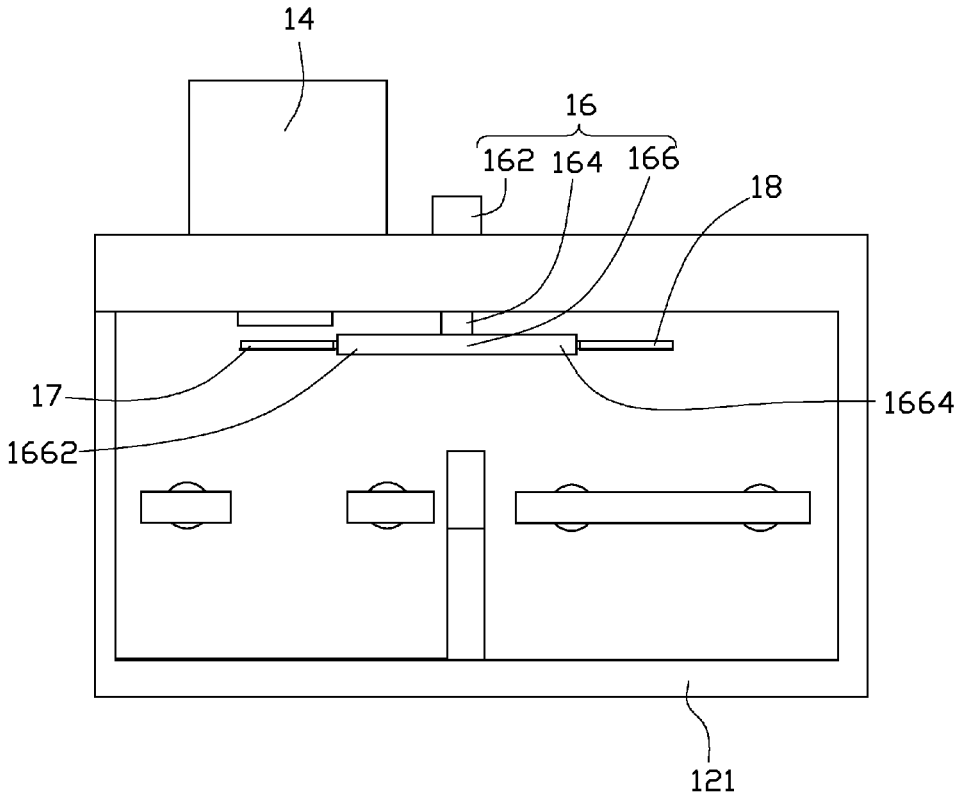
FIG. 3 is a planar view of the sandblasting apparatus of FIG. 1, with the door removed.
Figure 6:
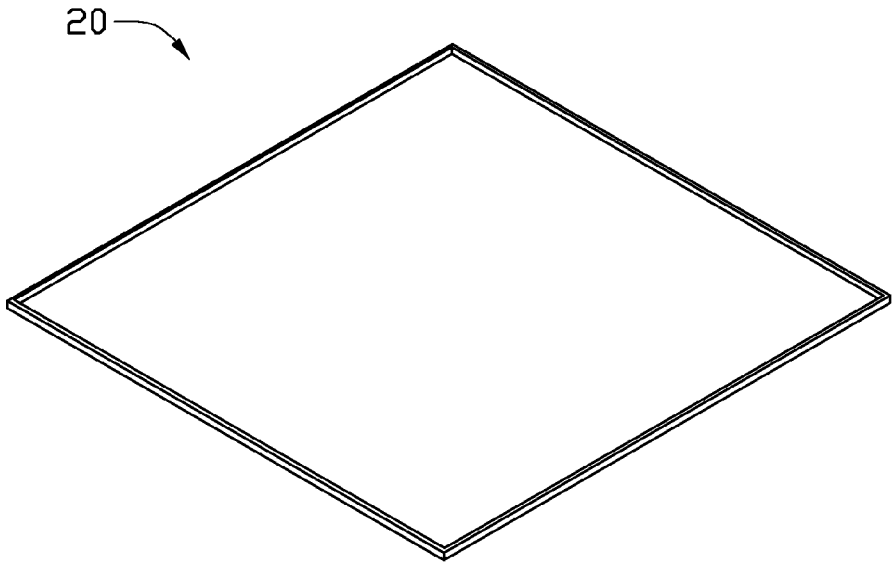
FIG. 6 is a schematic, isometric view of a plate-shaped workpiece.
Figure 7:
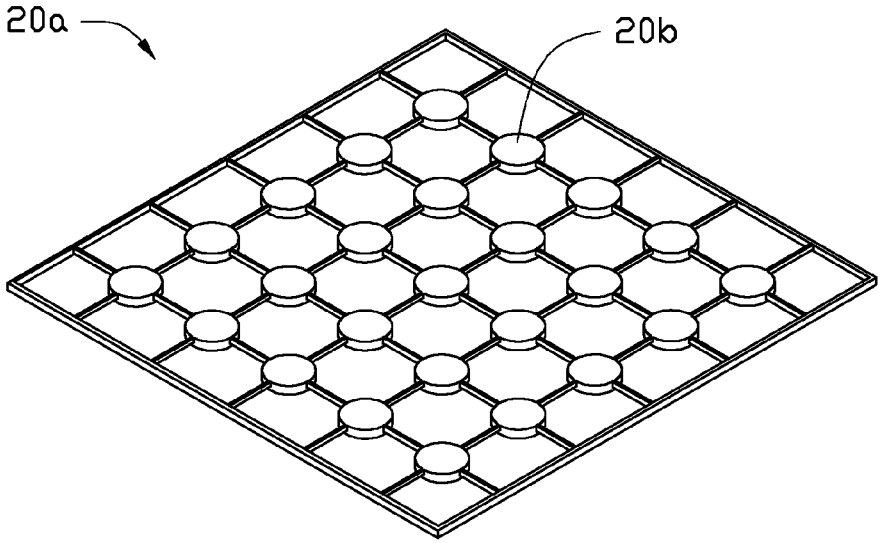
FIG. 7 is a schematic, isometric view of a tablet network, after the plate-shaped workpiece being cut by a sandblasting assembly of FIG. 3.

Referring to FIGS. 1-3, a sandblasting apparatus 10, according to a first exemplary embodiment, is configured for cutting a plate-shaped workpiece 20 (shown in FIG. 6) into a tablet network 20*a*, (shown in FIG. 7) and cutting the tablet network 20*a*, into a number of tablets 20*b*, (shown in FIG. 7).

The sandblasting apparatus 10 includes a chamber 12, a sandblasting assembly 14, a support assembly 15, a mask switching member 16, a first mask 17, a second mask 18, and a conveyor assembly 19.

The chamber 12 is substantially a cube and defines a cavity 12*a*. The chamber 12 includes an upper wall 120, a lower wall 121, a left sidewall 122, a right sidewall 123, a front sidewall 124, a back sidewall 125, and a partition plate 126. The upper wall 120 is substantially parallel to the lower wall 121. The left sidewall 122 is substantially parallel to the right sidewall 123. The front sidewall 124 is substantially parallel to the back sidewall 125. The left sidewall 122, the front sidewall 124, the right sidewall 123, and the back sidewall 125 are connected end-to-end to each other. The left sidewall 122, the front sidewall 124, the right sidewall 123, and the back sidewall 125 connect the upper wall 120 to the lower wall 121. The upper wall 120 defines a first through hole 127 and a second through hole 128 apart from the first through hole 127. A door 13 is attached to the front sidewall 124 and is configured for closing or opening the cavity 12*a*. The partition plate 126 extends from the lower wall 121 and divides the cavity 12*a* into a preparation cavity 12*b* and a spraying cavity 12*c*. The partition plate 126 is apart from the upper wall 120 to make the preparation cavity 12*b* communicate with the spraying cavity 12*c*. The lower wall 121 defines a number of vent ports 129 in the spraying cavity 12*c*. The diameter of the vent port 129 is larger than those of the tablets 20*b* and the size of the cutting scrap, and is less than those of sand sprayed by the sandblasting assembly 14. That is, the sand can pass through the vent port 129, while the tablets 20*b* and the cutting scrap cannot pass through the vent port 129.

The sandblasting assembly 14 is positioned on the upper wall 120. The sandblasting assembly 14 extends through the first through hole 127 and enters the spraying cavity 12*c*. A portion of the sandblasting assembly 14 outside the chamber 12 is connected to a sand supplying unit (not shown). A portion of the sandblasting assembly 14 inside the chamber 12 is opposite to the support assembly 15.

The support assembly 15 includes two support arms 152 and two first rollers 154. The two support arms 152 are apart from each other. One end of each support arm 152 is fixed to the back sidewall 125, and the other end of each support arm 152 is a free end. Each arm 152 defines a first fixing hole 156. The first rollers 154 are fixed in the first fixing holes 156 and are driven to rotate by a driving member (not shown). The support assembly 15 is configured for supporting the plate-shaped workpiece 20 and the tablet network 20*a* and aligning the plate-shaped workpiece 20 and the tablet network 20*a* with the sandblasting assembly 14.

The mask switching member 16 includes a stator 162, a rotor 164, and a support rod 166. The stator 162 is fixed to the upper wall 120 and is apart from the sandblasting assembly 14. The rotor 164 extends from the stator 162 and passes through the second through hole 128 to enter the cavity 12*a*. The support rod 166 is fixed to a distal end of the rotor 164 and includes a first end 1662 and a second end 1664 opposite to the first end 1662. The first end 1662 and the second end 1664 are at opposite sides of the rotor 164.

Figure 4:
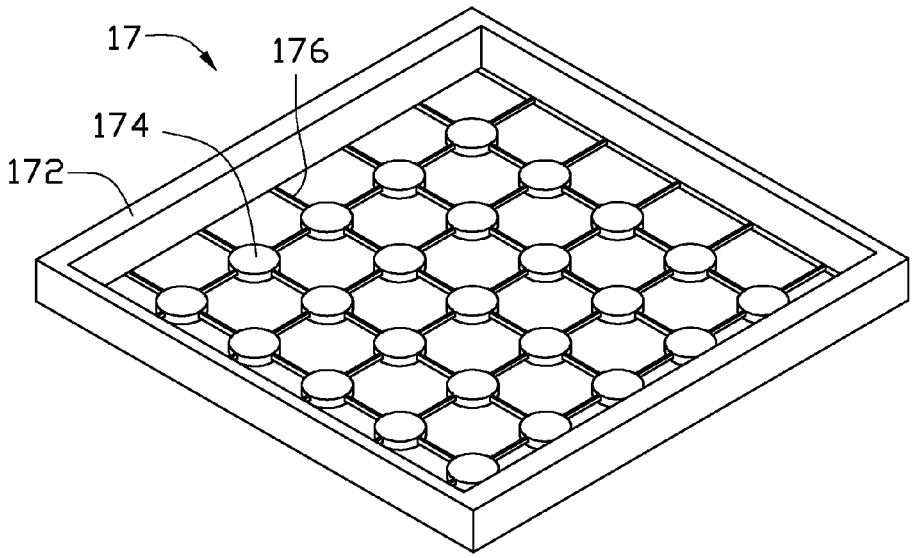
FIG. 4 is a schematic, isometric view of a first mask of the sandblasting apparatus of FIG. 3.

Referring to FIG. 4, the first mask 17 includes a first frame 172, a first shielding portion array including a number of first shielding portions 174, and a number of first connection portions 176. The first frame 172 is substantially rectangular. The first frame 172 is fixed to the first end 1662 and is parallel to the lower wall 121. The first shielding portion array is positioned in the first frame 172. In this embodiment, the first shielding portion array is a rectangular array. Each first shielding portion 174 has a shape conforming to the corresponding tablet 20*b*. The first connection portions 176 are positioned in the first frame 172. The first connection portions 176 are interconnected between the first shielding portions 174 and connect the first shielding portions 174 to the first frame 172 in a first fashion. In this embodiment, four first connection portions 176 are equidistantly arranged around the first shielding portion 174. Four first joints between the first connection portions 176 and each first shielding portion 174 are homogeneous distributed.

Figure 5:
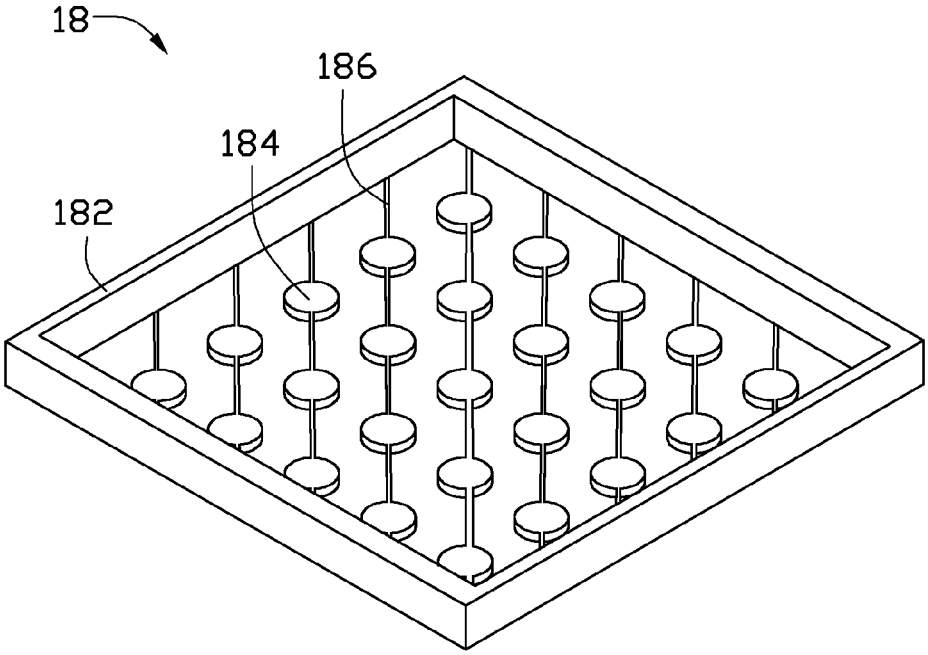
FIG. 5 is a schematic, isometric view of a second mask of the sandblasting apparatus of FIG. 3.

Referring to FIG. 5, the second mask 18 includes a second frame 182, a second shielding portion array including a number of second shielding portions 184, and a number of second connection portions 186. The second frame 182 is substantially rectangular. The second frame 182 is fixed to the second end 1664 and is parallel to the lower wall 121. The second shielding portion array is positioned in the second frame 182. In this embodiment, the second shielding portions 184 have a same pattern as that of the first shielding portions 174. That is, the second shielding portion array is the same as the first shielding portion array. The shape of the second shielding portions 184 are the same as those of the first shielding portions 174. The second connection portions 186 are positioned in the second frame 182. The second connection portions 186 are interconnected between the second shielding portions 184 and connect the second shielding portions 184 to the second frame 182 in a second fashion different from the first fashion. The second connection portions 186 are distinctly oriented from the first connection portions 176. In this embodiment, two second connection portions 186 are equidistantly arranged around each second shielding portion 184. Two second joints between the second connection portions 186 and each second shielding portion 184 are homogeneous distributed. The positions of the first joints are different from that of the second joints. In other words, if the first shielding portions 174 are overlapped by the second shielding portions 184, the second connection portions 186 underlaps from the first connection portions 176.

In other embodiments, the first frame 172 and the second frame 182 may be round, and the first shielding portion array and the second shielding portion array may be a circular array.

Referring to FIG. 2, the conveyor assembly 19 is positioned in the preparation cavity 12*a*. The conveyor assembly 19 is higher than the partition plate 126 and coplanar with the support assembly 15. The conveyor assembly 19 includes a support plate 192 and two second rollers 194. One end of the support plate 192 is fixed to the back sidewall 125, and the other end of the support plate 192 is a free end. Two second fixing holes 196 are defined in the support plate 192 and are apart from each other. The second rollers 194 are fixed in the second fixing holes 196 and are driven to rotate by a driving member (not shown). The conveyor assembly 19 is configured for conveying the plate-shaped workpiece 20 to the support assembly 15.

In other embodiments, the structure of the conveyor assembly 19 may be the same as that of the support assembly 15.

Referring to FIGS. 2-7, a method for machining a plate-shaped workpiece 20, using the sandblasting apparatus 10, includes the following steps.

First, the door 13 is opened and the plate-shaped workpiece 20 is supported on the conveyor assembly 19.

Second, the door 13 is closed, the plate-shaped workpiece 20 is conveyed to the support assembly 15, and the plate-shaped workpiece 20 is aligned with the sandblasting assembly 14. In detail, the second rollers 194 are driven to roll by the driving member (not shown) so that the plate-shaped workpiece 20 moves toward the support assembly 15. The first rollers 154 are driven to roll by the driving member (not shown) so that the plate-shaped workpiece 20 is aligned with the sandblasting assembly 14.

Third, the plate-shaped workpiece 20 is covered by the first mask 17 and exposed by the second mask 18. In detail, the first mask 17 and the second mask 18 rotate with rotation of the stator 164. The first mask 17 covers the plate-shaped workpiece 20, while the second mask 18 exposes the plate-shaped workpiece 20.

Fourth, the plate-shaped workpiece 20 is cut into a tablet network 20*a*by spraying sand toward the plate-shaped workpiece 20 covered by the first mask 17.

Fifth, the tablet network 20*a*, is covered by the second mask 18 and is exposed by the first mask 17. In detail, the first mask 17 and the second mask 18 rotate with rotation of the stator 164. The second mask 18 covers the tablet network 20*a*, while the first mask 18 exposes the tablet network 20*a*.

Sixth, the tablet network 20*a* is cut into a number of tablets 20*b* by spraying sand toward the tablet network 20*a* covered by the second mask 18. During this step, the tablets 20*b* fall on the lower wall 121 in the spraying cavity 12*c*.

Seventh, sand stacked on the lower wall 121 in the spraying cavity 12*c* is evacuated from the chamber 12 through the vent ports 129.

Eighth, the door 13 is opened and the tablets 20*b* are removed from the cavity 12*a*.

During machining, no glue is needed, thus eliminating the need for the separation and glue cleaning. This saves time and money, and ensures a quality product. Further, the sand sprayed by the sandblasting assembly 14 and cutting scrap of the plate-shaped workpieces 20 are blocked by the door 13, which protects the operator.

Figure 8:
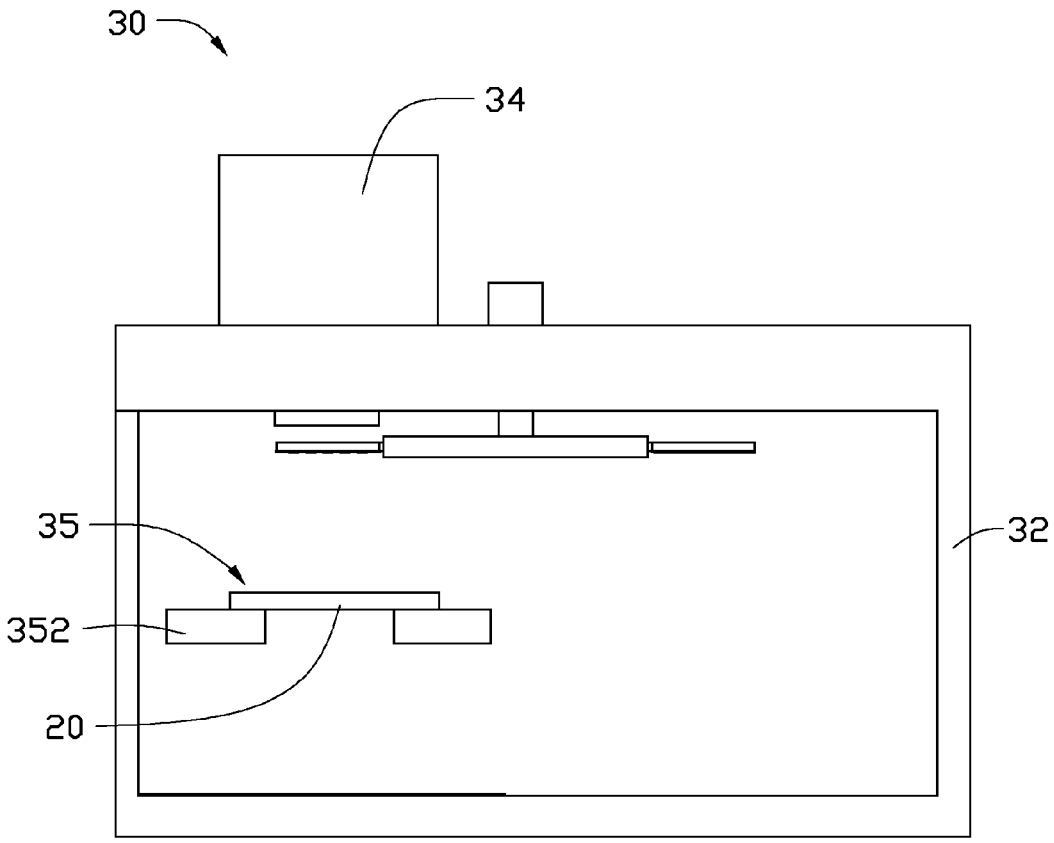
FIG. 8 is a planar view of a sandblasting apparatus, according to a second exemplary embodiment.

Referring to FIG. 8, a sandblasting apparatus 30, according to a second exemplary embodiment, is shown. The differences between the sandblasting apparatus 30 of this embodiment and the sandblasting apparatus 10 of the first embodiment are: a chamber 32 of the sandblasting apparatus 30 omits the partition plate, and the sandblasting apparatus 30 omits the conveyor assembly, and a support assembly 35 of the sandblasting apparatus 30 includes only two support arms 352 for supporting the plate-shaped workpiece 20.

During machining using the sandblasting apparatus 30, the plate-shaped workpiece 20 is directly supported by the support assembly 35. That is, the conveying step is omitted.

Figure 9:
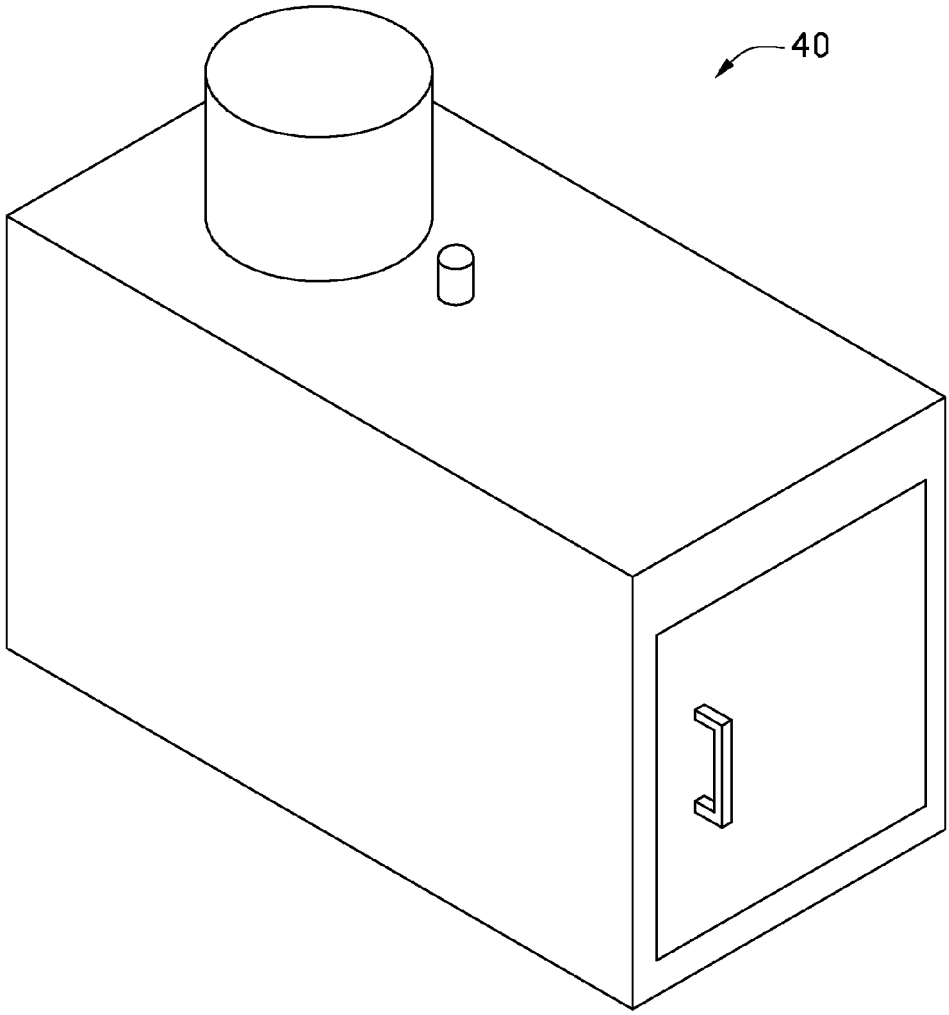
FIG. 9 is a schematic, isometric view of a sandblasting apparatus, according to a third exemplary embodiment.
Figure 10:
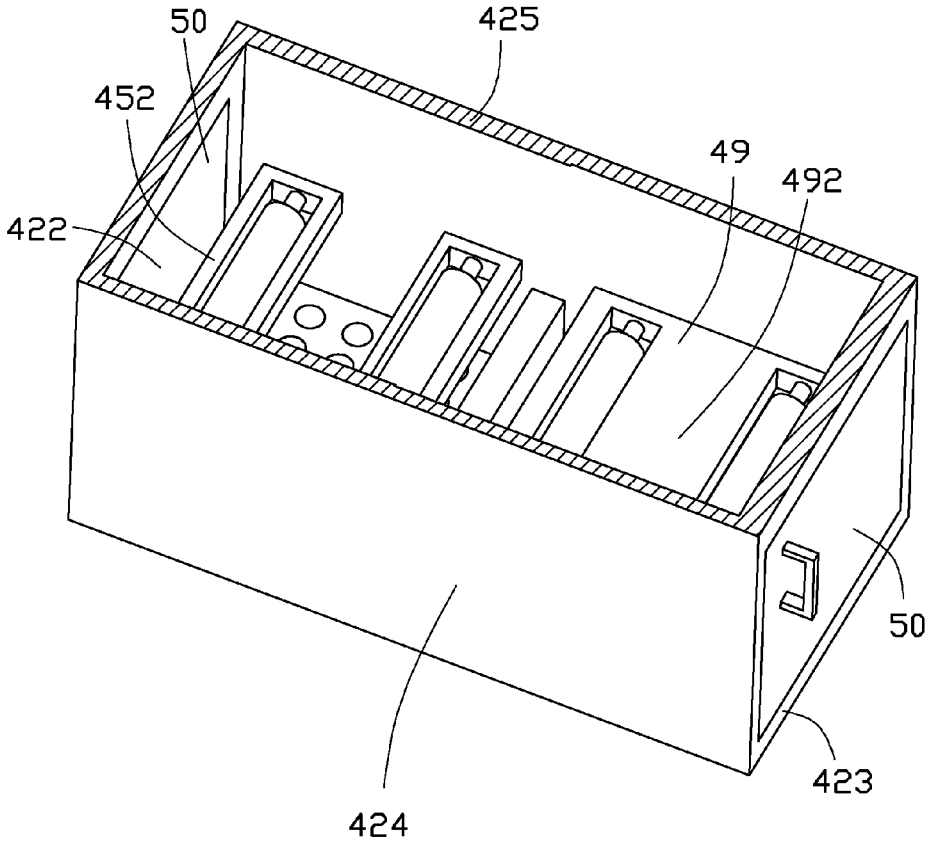
FIG. 10 is a cutaway view of the sandblasting apparatus of FIG. 9.

Referring to FIG. 9-10, a sandblasting assembly 40, according to a third exemplary embodiment, is shown. The differences between the sandblasting assembly 40 of this embodiment and the sandblasting apparatus 10 of the first embodiment are: one end of each of support arms 452 of the sandblasting assembly 40 is fixed to the back sidewall 425 and the other end of each of the support arms 452 is fixed to the front sidewall 424, one end of a support plate 492 of the sandblasting assembly 40 is fixed to the back sidewall 425, and the other end of the support plate 492 is fixed to the front sidewall 424, the sandblasting assembly 40 omits a door on a front wall 424, and two doors 50 are attached to a left sidewall 422 and a right sidewall 423, respectively.

During a machining process using the sand-blasting apparatus 40, the plate-shaped workpiece 20 is supported on the conveyor assembly 49 through the door 50 attached on the right sidewall 423. After the tablets 20*b* are formed, the tablets 20*b* are removed from the chamber through the door 50 attached on the left sidewall 422.

The advantages of the sandblasting apparatus 40 of the third exemplary embodiment are similar to those of the sandblasting apparatus 10 of the first exemplary embodiment. Further, the conveying step is steadier as two ends of the support plate 492 are fixed and two ends of the support arms 452 are fixed.

It is to be understood, however, that even though numerous characteristics and advantages of the present embodiments have been set forth in the foregoing description, together with details of the structures and functions of the embodiments. The disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A sandblasting apparatus for cutting a plate-shaped workpiece into a plurality of separate tablets, comprising:

a chamber defining a cavity;

a support assembly received in the cavity and configured for supporting the workpiece and the tablets;

a sandblasting assembly configured for spraying sand toward the workpiece;

a first mask located between the sandblasting assembly and the support assembly;

a second mask located between the sandblasting assembly and the support assembly; and a mask switching member configured for selectively placing the first mask or the second mask over the workpiece, the first mask configured for cooperating with the sandblasting assembly to remove unwanted portions of the plate-shaped workpiece thus obtaining a tablet network consisting of a plurality of tablets and a plurality of connecting portions interconnected between the tablets, the second mask configured for cooperating with the sandblasting assembly to remove the connecting portions of the tablet network thus obtaining a plurality of separated tablets.

2. The sandblasting apparatus as claimed in claim 1, wherein the chamber comprises an upper wall, a lower wall, a left sidewall, a right sidewall, a front sidewall, and a back sidewall, the upper wall is parallel to the lower wall, the left sidewall is parallel to the right sidewall, the front sidewall is parallel to the back sidewall, the left sidewall, the front sidewall, the right sidewall, and the back sidewall are connected end-to-end to each other, the left sidewall, the right sidewall, the front sidewall, and the back sidewall connect the upper wall to the lower wall.

3. The sandblasting apparatus as claimed in claim 2, further comprising a conveyor assembly received in the cavity, wherein the conveyor assembly is configured for conveying the plate-shaped workpiece to the support assembly.

4. The sandblasting apparatus as claimed in claim 3, wherein the support assembly comprises two support arms and two first rollers, each first roller is fixed in a corresponding support arm.

5. The sandblasting apparatus as claimed in claim 4, wherein one end of each of the support arms is fixed to the back sidewall, and the other end of each of the support arms is a free end.

6. The sandblasting apparatus as claimed in claim 5, wherein a door is attached on the front sidewall and is configured for closing the cavity.

7. The sandblasting apparatus as claimed in claim 4, wherein one end of each of the support arms is fixed to the back sidewall, and the other end of each of the support arms is fixed to the front sidewall.

8. The sandblasting apparatus as claimed in claim 7, wherein two doors are attached on the left sidewall and the right sidewall and are configured for closing the cavity.

9. The sandblasting apparatus as claimed in claim 3, wherein the conveyor assembly comprises a support plate and two second rollers, the support plate is coplanar with the support arms, and the two second rollers are fixed in the support plate and are spaced apart from each other.

10. The sandblasting apparatus as claimed in claim 9, wherein one end of the support plate is fixed to the back sidewall, and the other end of the support plate is a free end.

11. The sandblasting apparatus as claimed in claim 10, wherein a door is attached on the front sidewall and is configured for closing the cavity.

12. The sandblasting apparatus as claimed in claim 9, wherein one end of the support plate is fixed to the back sidewall, and the other end of the support plate is fixed in the front sidewall.

13. The sandblasting apparatus as claimed in claim 12, wherein two doors are attached on the left sidewall and the right sidewall and are configured for closing the cavity.

14. The sandblasting apparatus as claimed in claim 3, wherein the mask switching member comprises a stator, a rotor, and a support rod, the stator is positioned on the upper wall, the rotor enters the cavity, the support rod is fixed on the rotor, the first mask and the second mask are fixed to opposite sides of the support rod.

15. The sandblasting apparatus as claimed in claim 14, wherein the first mask comprises a plurality of first shielding portions each having a shape conforming to the corresponding tablet, and a plurality of first connection portions interconnected between the first shielding portions.

16. The sandblasting apparatus as claimed in claim 15, wherein the second mask comprises a plurality of second shielding portions having a same pattern as that of the first shielding portions, and a plurality of second connection portions interconnected between the second shielding portions, the second connection portions distinctly oriented from the first connection portions.

* * * * *